US009574293B2

(12) United States Patent
Okuma

(10) Patent No.: US 9,574,293 B2
(45) Date of Patent: Feb. 21, 2017

(54) BODKIN

(71) Applicant: CLOVER MFG. CO., LTD., Osaka-shi, Osaka (JP)

(72) Inventor: Atsuko Okuma, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 0 days.

(21) Appl. No.: 14/816,616

(22) Filed: Aug. 3, 2015

(65) Prior Publication Data

US 2016/0040343 A1 Feb. 11, 2016

(30) Foreign Application Priority Data

Aug. 6, 2014 (JP) ..... 2014-160385

(51) Int. Cl.
*D05B 91/02* (2006.01)
*D04D 11/00* (2006.01)
*B25B 5/16* (2006.01)

(52) U.S. Cl.
CPC ..... *D05B 91/02* (2013.01); *B25B 5/16* (2013.01); *D04D 11/00* (2013.01)

(58) Field of Classification Search
CPC ..... D05B 91/02; D04D 11/00; A47C 21/022; A47C 21/028; A41H 43/00; B25B 5/16; B25B 5/163
USPC ..... D3/18, 28
See application file for complete search history.

(56) References Cited

U.S. PATENT DOCUMENTS 748,423 A * 12/1903 Schaffner ..... A47C 21/022 24/538
829,118 A * 8/1906 Meek ..... A47C 21/022 24/504
1,584,387 A * 5/1926 Littlejohn ..... A47C 21/022 5/282.1
D405,251 S * 2/1999 Nazemi ..... D3/18
2014/0345089 A1* 11/2014 Kaalberg ..... A47C 21/022 24/72.5

FOREIGN PATENT DOCUMENTS

FR 1097738 A * 7/1955
GB 239760 A * 9/1925
GB 2103270 A * 2/1983
JP 2014-105420 A 6/2014

* cited by examiner

*Primary Examiner* — Ismael Izaguirre
(74) *Attorney, Agent, or Firm* — Hamre, Schumann, Mueller & Larson, P.C.

(57) ABSTRACT

A bodkin includes first and second holding plates, an operation plate and an elongated bar member. The second holding plate overlaps with the first holding plate. The operation plate is rotatably supported by the first holding plate with a part of the second holding plate disposed between the first holding plate and the operation plate. The bar member is connected to the first holding plate so that the operation plate is operable independently of the bar member. Use of the operation plate enables the bodkin to selectively take an opened state and a closed state. In the opened state, the two holding plates are apart from each other, providing a gap into which an end of a string can be inserted. In the closed state, the two holding plates are brought closer to each other, thereby pinching the end of the string between them.

10 Claims, 7 Drawing Sheets

BODKIN

BACKGROUND OF THE INVENTION

1. Field of the Invention

The present invention relates to a bodkin used for, for example, drawing an elastic string or the like through an appropriate portion in a clothing product or a needle craft product, such as a waist portion of a skirt or pants.

2. Description of Related Art

Conventionally, various types of bodkins used for drawing an elastic string or the like have been proposed (see JP 2014-105420A, for example). The bodkin described in JP 2014-105420A includes a clip portion (4) and a bar portion (5) connected to the clip portion. The clip portion (4) has an upper holding plate (1), a lower holding plate (2), and an operation plate (3). The operation plate is connected to rear end portions of the upper holding plate and the lower holding plate. Front end portions of the upper holding plate and the lower holding plate are opened and closed by rotating the operation plate. The bar portion (5) is integrally connected to a rear end portion of the operation plate.

According to the thus configured bodkins, as shown in FIGS. 5 and 7A, etc. in JP 2014-105420A, when the bar portion is rotated to be perpendicular to the upper and lower holding plates, the front end portions of the upper and lower holding plates can be opened. In this state, as shown in FIG. 7B, a holding target object such as an elastic string, for example, is placed between the front end portions of the upper and lower holding plates, and the bar portion is rotated from the state shown in FIG. 7B to be parallel to the upper and lower holding plates. Consequently, as shown in FIG. 7C, the front end portions of the upper and lower holding plates are closed, and the holding target object can be held between the upper and lower holding plates. With the operation that rotates the relatively long bar portion, the operation plate formed in one piece with the bar portion is rotated. Accordingly, the upper and lower holding plates can be opened and closed with a small force.

The bodkin holding the holding target object is drawn through, for example, a tubular casing such as a waist portion of a skirt. When drawing the bodkin through the casing, the bodkin is pushed forward with the bar portion serving as a leading end and the clip portion (the upper and lower holding plates) holding the holding target object following the bar portion. At that time, the bar portion and the upper and lower holding plates may rotate relative to each other. With this rotation, the upper and lower holding plates are opened, and the holding target object is released from the bodkin. Consequently, the operation has to be performed again from the first step, which impairs the ease of use.

In the case of a waist portion of a skirt and the like, the casing on the whole is in the shape of a ring, and is curved as appropriate. Accordingly, when the conventional bodkin is drawn through such a casing, the bar portion and the upper and lower holding plates easily rotate relative to each other due to the influence of the curved portion of the casing, and, thus, the above-described problem easily occurs.

SUMMARY OF THE INVENTION

The present invention has been proposed under the above circumstances, and it is an object thereof to provide a bodkin having improved ease of use compared with conventional bodkins.

In order to solve the above-described problem, the present invention provides the following technical means.

According to an aspect of the present invention, there is provided a bodkin provided with: a first holding plate including a base end portion and a first front end portion that are spaced apart from each other in a first direction; a second holding plate including a second front end portion and a base end portion opposite to the second front end portion, where the second front end portion is arranged to overlap with the first front end portion as viewed in a second direction (a thickness direction of the first holding plate) and perpendicular to the first direction; an operation plate including a base end portion rotatable relative to the first holding plate about a third direction perpendicular to both the first direction and the second direction, while also being configured to switch between an opened state and a closed state, where in the opened state the first front end portion and the second front end portion are apart from each other, and in the closed state the first front end portion and the second front end portion are in contact with each other; and a bar member connected to the base end portion of the first holding plate and elongated in the first direction. In an embodiment, the opened state is attained by the operation plate standing upright with respect to the first holding plate, while the closed state is attained by the operation plate overlapping with the first holding plate, thereby pressing the second holding plate toward the first holding plate.

Preferably, the base end portion of the second holding plate is supported by the first holding plate rotatably about the third direction. The first holding plate is provided with a pair of upright pieces each disposed between the base end portion of the first holding plate and the first front end portion, where the upright pieces are spaced apart from each other in the third direction and extend in the second direction. The base end portion of the operation plate is rotatably supported by the pair of upright pieces.

Preferably, the pair of upright pieces are formed with holes, respectively, that are paired with each other in the third direction. The base end portion of the operation plate is provided with projecting portions that are spaced apart from each other in the third direction and fitted into the holes of the upright pieces, respectively.

Preferably, the operation plate includes a front end portion opposite to the base end portion of the operation plate and includes an extending piece that extends from the base end portion of the operation plate and is capable of pressing the second holding plate, where the extending piece extends in a direction intersecting a direction connecting the base end portion of the operation plate and the front end portion of the operation plate.

Preferably, in the closed state the second holding plate is elastically pressed against the first holding plate by the extending piece.

Preferably, the first front end portion is provided with a plurality of first teeth projecting toward the second holding plate and arranged at intervals in the third direction, while the second front end portion is provided with a plurality of second teeth projecting toward the first holding plate and arranged at intervals in the third direction. The plurality of first teeth and the plurality of second teeth are alternately arranged in the third direction.

Preferably, the bar member includes an elastically deformable body portion elongated in the first direction. The body portion has a cross section that is greater in size in the third direction than in the second direction.

Preferably, the bar member includes a leading portion connected to the body portion, and the leading portion tapers with increasing distance from the body portion.

Preferably, at least a part of the leading portion has a cross section that is greater in area than the cross section of the body portion.

Other features and advantages of the present invention will become more apparent from the detailed description given below with reference to the attached drawings.

DESCRIPTION OF THE PREFERRED EMBODIMENTS

Figure 1:
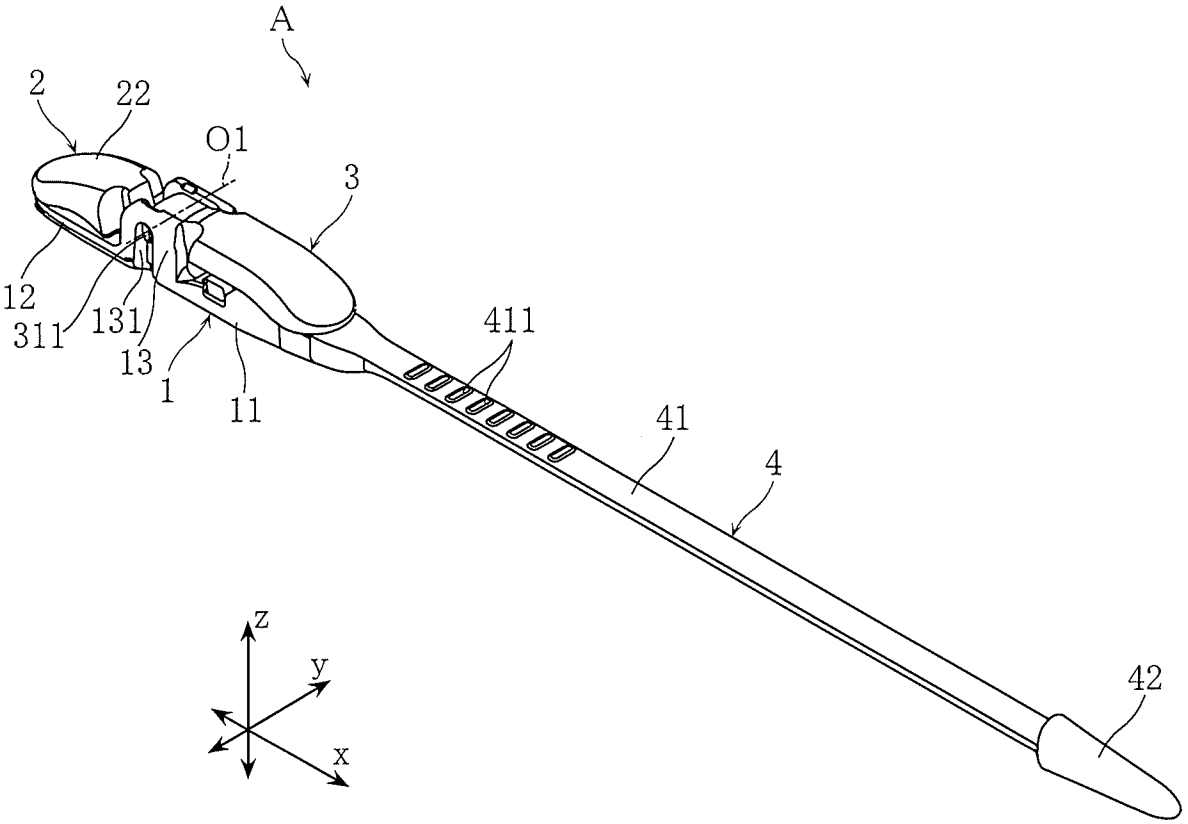
FIG. 1 is a perspective view showing an example of a bodkin according to the present invention.

Hereinafter, preferred embodiments of the present invention will be specifically described with reference to the drawings.

FIGS. 1 to 5 show an embodiment of a bodkin according to the present invention. A bodkin A of this embodiment includes a lower holding plate 1, an upper holding plate 2, an operation plate 3, and a bar member 4.

The lower holding plate 1 extends in a constant direction (the direction x) from a base end portion 11 to a front end portion 12. In this embodiment, the lower holding plate 1 has a pair of upright pieces 13. The pair of upright pieces 13 are provided at both sides in a width direction (the direction y at a right angle with respect to the direction x) of the lower holding plate 1 at a position between the base end portion 11 and the front end portion 12 in the direction x. The pair of upright pieces 13 stand upright in a height direction (the direction z at a right angle with respect to both of the direction x and the direction y). The pair of upright pieces 13 are for rotatably supporting the operation plate 3.

Figure 6:
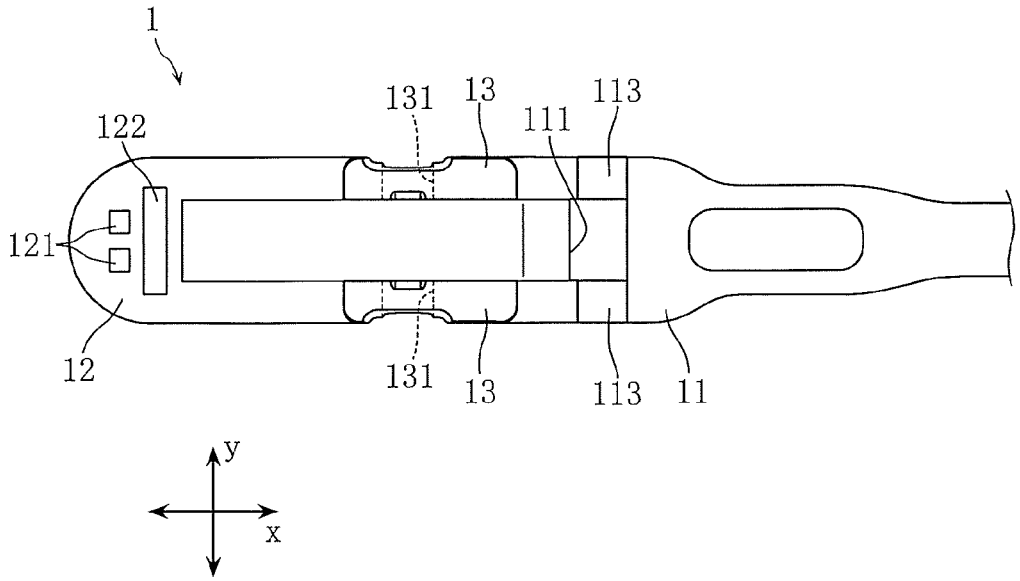
FIG. 6 is a plan view of a lower holding plate (first holding plate).

Holes 131 are respectively formed at the pair of upright pieces 13. As shown in FIG. 6, the holes 131 are paired with each other in the direction y. In this embodiment, the holes 131 are formed through the upright pieces 13 in their thickness direction, and are elongated holes that extend in the direction z.

Figure 4:
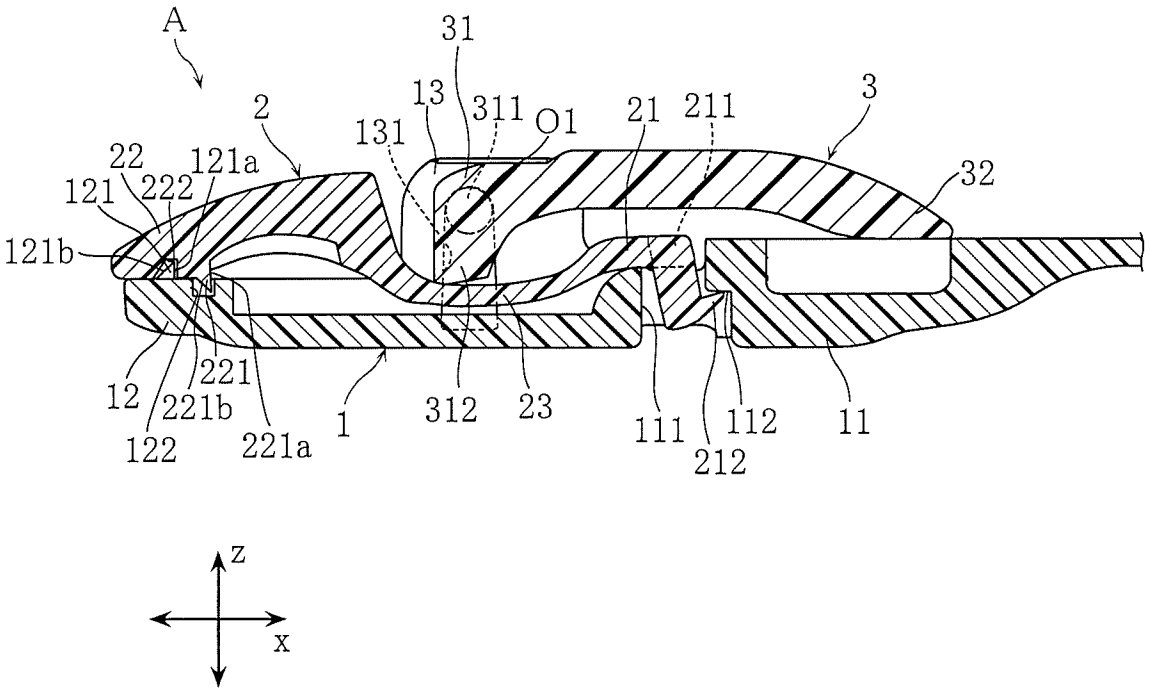
FIG. 4 is an enlarged cross-sectional view of a main portion taken along the line IV-IV in FIG. 3.

As shown in FIGS. 4 and 6, the front end portion 12 of the lower holding plate 1 is provided with a plurality of teeth 121 and a recess 122. The plurality of teeth 121 project toward the upper holding plate 2, and are arranged side by side at intervals in the direction y. Each of the teeth 121 has an upright face 121*a* positioned on the base end side and an inclined face 121*b* positioned on the front end side. The upright face 121*a* extends substantially at a right angle from the lower holding plate 1. The inclined face 121*b* is inclined so as to be sloping downward toward the front end of the lower holding plate 1. The recess 122 is provided closer to the base end side in the direction x than each of the teeth 121 is. The recess 122 is a portion that teeth 221 (described later) provided on the upper holding plate 2 can enter.

As shown in FIGS. 4 and 6, an opening 111 is formed at the base end portion 11 of the lower holding plate 1. The opening 111 is formed through the lower holding plate in its thickness direction (the direction z). The opening 111 has a size in the direction x that becomes larger toward the lower side. Accordingly, a step portion 112 facing downward is formed at the base end portion 11.

Furthermore, a pair of cutouts 113 are formed at both sides in the direction y of the base end portion 11 of the lower holding plate 1. The cutouts 113 are portions that receive protrusions 211 (described later) of the upper holding plate 2.

The lower holding plate 1 is formed in one piece, for example, using a synthetic resin having a predetermined strength, such as polyacetal.

Figure 7:
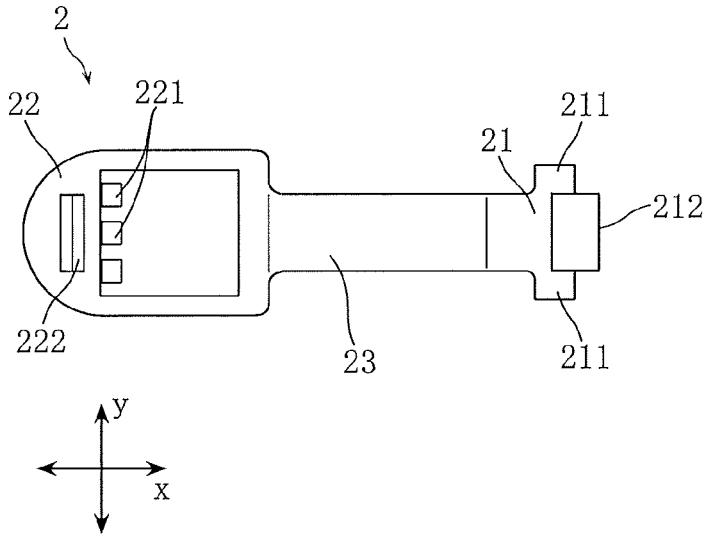
FIG. 7 is a view of an upper holding plate (second holding plate), viewed from the inner side facing the lower holding plate.

As shown in FIGS. 4 and 7, the upper holding plate 2 on the whole extends in the direction x from a base end portion 21 to a front end portion 22. The upper holding plate 2 overlaps, at least at the front end portion 22 thereof, the front end portion 12 of the lower holding plate 1 when viewed in the direction z (the thickness direction of the lower holding plate 1).

In the upper holding plate 2, the base end portion 21 and an intermediate portion 23 between the base end portion 21 and the front end portion 22 has a width (the size in the direction y) smaller than that of the front end portion 22. The intermediate portion 23 and the base end portion 21 have substantially a constant thickness, and are curved or bent as appropriate. More specifically, as shown in FIG. 4, the intermediate portion 23 is curved so as to project downward. The thickness of the intermediate portion 23 is relatively small, and, thus, the intermediate portion 23 can be elastically deformed relatively easily with pressure applied in the thickness direction.

As shown in FIGS. 4 and 7, the base end portion 21 of the upper holding plate 2 is provided with a pair of protrusions 211. The pair of protrusions 211 are portions that can be fitted into the pair of cutouts 113 of the lower holding plate 1. The base end portion 21 is bent by about 90° at the point where the protrusions 211 are formed, and extends downward. An edge of this bent portion is provided with a catch claw 212. As seen from FIGS. 4, 6, and 7, when attaching the upper holding plate 2 to the lower holding plate 1, the bent portion of the base end portion 21 is inserted into the opening 111 of the lower holding plate 1, and the catch claw 212 is caught by the step portion 112 of the lower holding plate 1.

As shown in FIGS. 4 and 7, the front end portion 22 of the upper holding plate 2 is provided with a plurality of teeth 221 and a recess 222. The plurality of teeth 221 project toward the lower holding plate 1, and are arranged side by side at intervals in the direction y. Each of the teeth 221 has an upright face 221*a* positioned on the base end side and an inclined face 221*b* positioned on the front end side. The upright face 221*a* extends substantially at a right angle from the upper holding plate 2. The inclined face 221*b* is inclined so as to be sloping upward toward the front end of the upper holding plate 2.

As shown in FIGS. 4, 6, and 7, the teeth 221 of the upper holding plate 2 and the teeth 121 of the lower holding plate 1 are alternately arranged in the direction y.

The recess 222 is provided closer to the front end side in the direction x than each of the teeth 221 is. The recess 222 is a portion that the teeth 121 of the lower holding plate 1 can enter.

The upper holding plate 2 is formed in one piece, for example, using a synthetic resin such as polyacetal.

Figure 2:
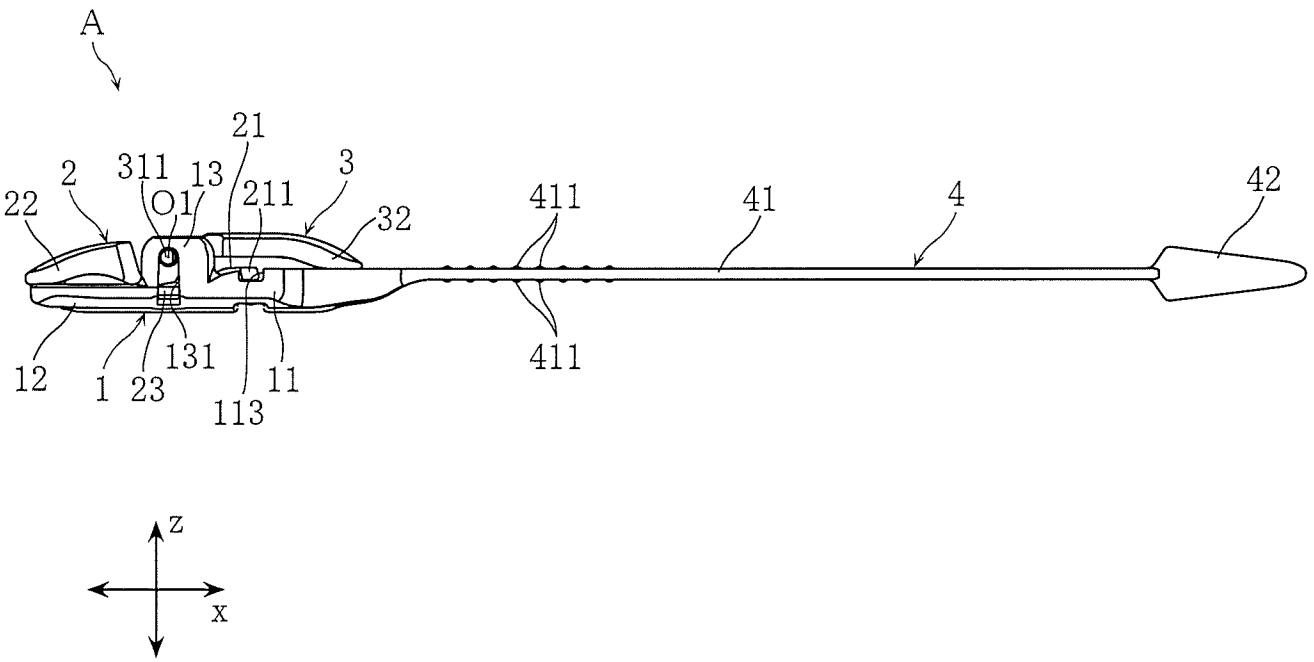
FIG. 2 is a side view of the bodkin shown in FIG. 1.

The operation plate 3 is for switching the state of the front end portions 12 and 22 of the lower holding plate 1 and the upper holding plate 2 between an opened state and a closed state, and is supported so as to be rotatable with respect to the lower holding plate 1. As shown in FIGS. 1, 2, and 4, etc., the operation plate 3 extends substantially in a constant direction from a base end portion 31 to a front end portion 32.

In this embodiment, a pair of projecting portions 311 are provided at both sides in a width direction (the direction y) of the base end portion 31 of the operation plate 3. The projecting portions 311 are inserted into the holes 131 of the pair of upright pieces 13 of the lower holding plate 1. Accordingly, the operation plate 3 can rotate about an axis O1 that is along the direction y.

The base end portion 31 of the operation plate 3 is provided with an extending piece 312. The extending piece 312 extends in a direction that intersects the direction in which the operation plate 3 extends from the base end portion 31 to the front end portion 32. In this embodiment, the extending piece 312 extends in a direction at a right angle with respect to both the direction in which the operation plate 3 extends and the direction y (the direction in which the axis O1 extends). The extending piece 312 is a portion for pressing the upper holding plate 2.

The operation plate 3 is formed in one piece, for example, using a synthetic resin such as polyacetal.

The bar member 4 is connected to the base end portion 11 of the lower holding plate 1, and extends in the direction x in a direction away from the lower holding plate 1. In this embodiment, the bar member 4 is continued to the base end portion 11, and is formed in one piece with the lower holding plate 1.

The bar member 4 has a body portion 41 and a leading portion 42 connected to an end of the body portion 41. The body portion 41 is elongated in the direction x with a uniform cross section, and occupies most of the length in the direction x of the bar member 4. The body portion 41 has a rather flat cross section whose size in the direction y is greater than that in the direction z. In this embodiment, the body portion 41 has a cross section in the shape of a rectangle whose longer side is in the direction y and shorter side is in the direction z. In this embodiment, the body portion 41 is provided, on each of its faces (an upper face and a lower face) oriented in the direction z, with a plurality of protrusions 411. The plurality of protrusions 411 are arranged side by side at predetermined intervals in the direction x. For example, the sizes of the body portion 41 are such that the length in the direction x is approximately 100 mm, the width in the direction y is approximately 4 mm, and the thickness in the direction z is approximately 1 mm.

Figure 3:
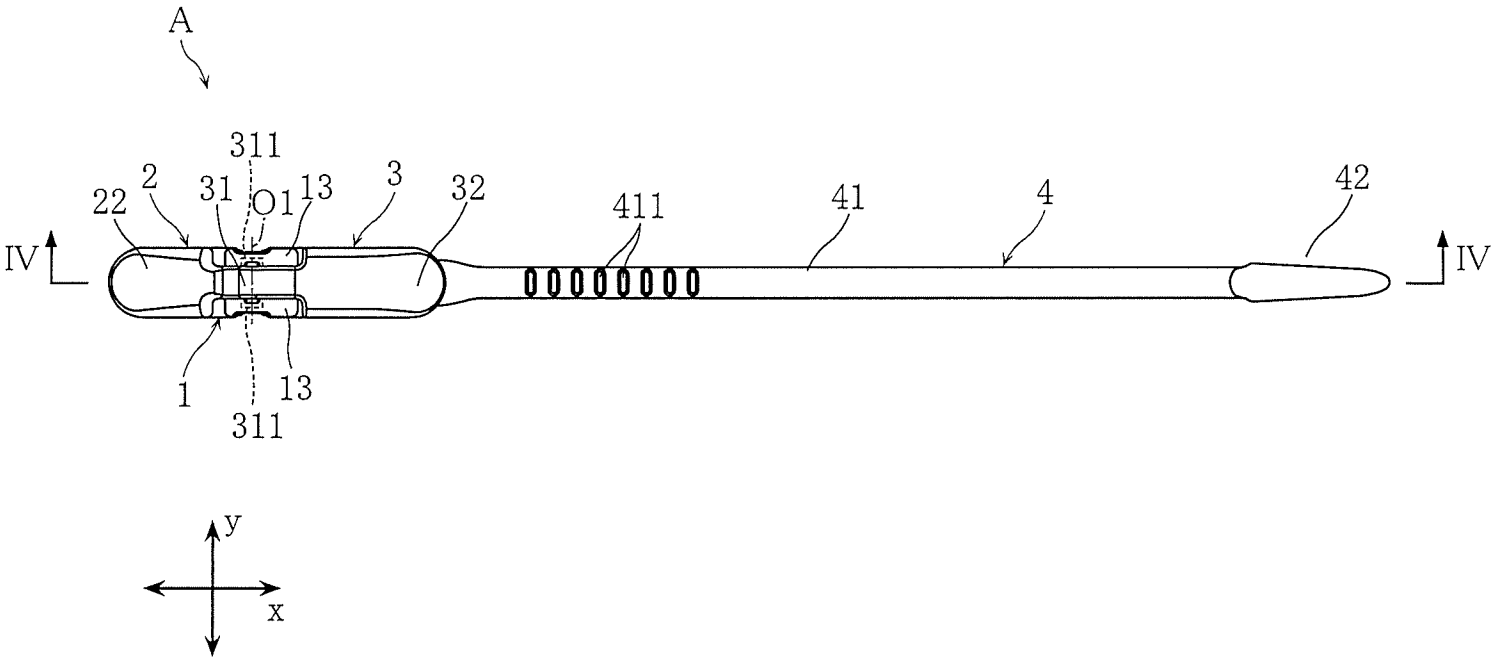
FIG. 3 is a plan view of the bodkin shown in FIG. 1.

As shown in FIGS. 1 to 3, the leading portion 42 is formed to taper with increasing distance from the body portion 41. The cross section (orthogonal to the direction x) of the leading portion 42, at an end portion thereof connected to the body portion 41, is greater than the cross section of the body portion 41. In this embodiment, the leading portion 42 is in the shape of a pointed triangle when viewed in the direction y.

Figure 8:
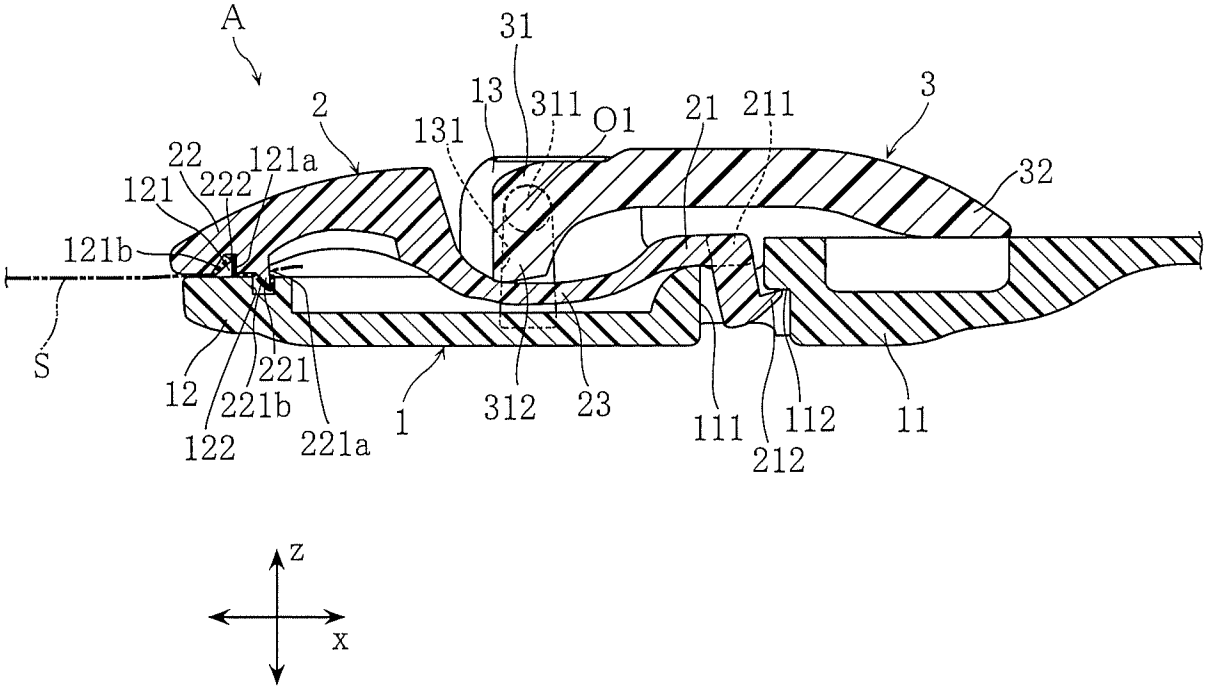
FIG. 8 is a cross-sectional view as in FIG. 4, illustrating a method for using the bodkin.

Next, a method for using the thus configured bodkin A and actions thereof will be described with reference to FIGS. 4, 5, and 8.

Figure 5:
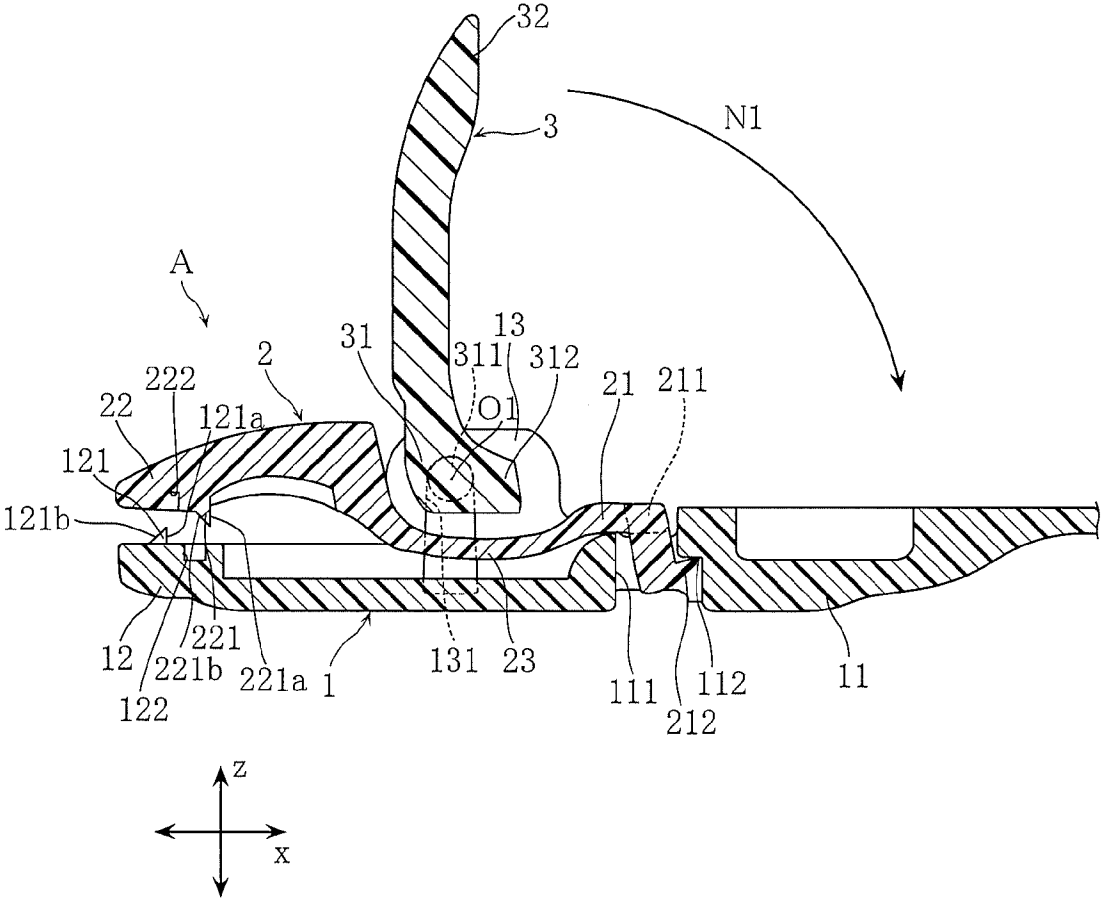
FIG. 5 is a cross-sectional view as in FIG. 4, illustrating a method for using the bodkin.

As shown in FIG. 5, when the operation plate 3 is oriented so as to stand upright from the lower holding plate 1, the extending piece 312 of the operation plate 3 extends substantially in the direction x. At that time, the extending piece 312 has been separated from the upper holding plate 2, and the upper holding plate 2 is in a natural state. Thus, as shown in FIG. 5, the lower holding plate 1 and the upper holding plate 2 are in an opened state in which the front end portions 12 and 22 are apart from each other.

Meanwhile, from the state shown in FIG. 5, the front end portion 32 of the operation plate 3 is pushed downward toward the base end portion 11 of the lower holding plate 1, as indicted by the arrow N1 in FIG. 5. Accordingly, the operation plate 3 rotates about the axis O1 in the projecting portions 311, and overlaps the lower holding plate 1 (see FIG. 4). At that time, the extending piece 312 of the operation plate 3 extends downward, and the intermediate portion 23 of the upper holding plate 2 is elastically pressed by the extending piece 312 toward the lower holding plate 1. Thus, the front end portions 12 and 22 of the lower holding plate 1 and the upper holding plate 2 are in contact with each other, and are closed.

When using the bodkin A, first, the operation plate 3 is caused to stand upright, so that the lower holding plate 1 and the upper holding plate 2 are opened (see FIG. 5). Then, an end portion of a holding target object such as an elastic string is placed between the front end portions 12 and 22 of the lower holding plate 1 and the upper holding plate 2, and the operation plate 3 is rotated to overlap the lower holding plate 1. Accordingly, as shown in FIG. 8, the lower holding plate 1 and the upper holding plate 2 are closed, and the holding target object S is held between the teeth 121 and 221 of the holding plates 1 and 2.

Next, the bodkin A is drawn through, for example, a tubular casing such as a waist portion of a skirt. In this example, the casing on the whole is in the shape of a ring, and is curved as appropriate. First, the leading portion 42 is inserted into the casing from an opening provided at an appropriate point of the casing, and the bodkin A is pushed forward from the rear end in a state where the lower holding plate 1 and the upper holding plate 2 are pinched with the hand. Consequently, the tapered leading portion 42 pushes its way through the fabric and smoothly advances in the casing. The bodkin A is inserted until its rear end (the lower holding plate 1 and the upper holding plate 2) enters the casing. Subsequently, in a state where a portion near that rear end is pinched with one of the hands from the outside of the fabric, a portion of the fabric near the boundary between the leading portion 42 and the body portion 41 is sent rearward with the other hand, and the sent portion of the fabric is pinched again with the one hand. By repeating this operation, the leading portion 42 is pushed to the opening of the casing. Then, the leading portion 42 is projected out from the opening of the casing, and is pulled, so that the entire bodkin A is pulled out from the opening. If the bodkin A is drawn through the casing in this manner, the holding target object S can be inserted through that casing.

The bar member 4 is connected to the lower holding plate 1. When the lower holding plate 1 and the upper holding plate 2 are closed, the operation plate 3 has overlapped the lower holding plate 1. With this configuration, when drawing the bodkin A through a tubular casing, the operation plate 3 does not rotate relative to the lower holding plate 1. Thus, for example, even when the casing is curved, the lower holding plate 1 and the upper holding plate 2 are kept closed as appropriate, and continuously hold the holding target object S. Accordingly, the problem that the lower holding plate 1 and the upper holding plate 2 are accidentally opened during use of the bodkin A does not occur, that is, the ease of use is good.

The lower holding plate 1 has the pair of upright pieces 13 that stand upward (in the direction z), and the base end portion 31 of the operation plate 3 is rotatably supported by the pair of upright pieces 13. With this configuration, space can be ensured between the operation plate 3 and the lower holding plate 1, and the upper holding plate 2 can be arranged in that space. With this improved design in the arrangement, the upper holding plate 2 can be pressed toward the lower holding plate 1 by rotating the operation plate 3.

The operation plate 3 has the extending piece 312 that extends from the base end portion 31. The extending piece 312 extends in a direction that intersects the direction in which the operation plate 3 extends from the base end portion 31 to the front end portion 32. With this configuration, the extending piece 312 can function as a cam for pressing the upper holding plate 2. Accordingly, the upper holding plate 2 can be pressed as appropriate by rotating the operation plate 3.

The upper holding plate 2 in a natural state is in an opened state, and, in a closed state, is elastically pressed by the extending piece 312 of the operation plate 3. With this configuration, the lower holding plate 1 and the upper holding plate 2 can be easily and properly switched from the closed state to the opened state, by rotating the operation plate 3.

The plurality of teeth 121 of the lower holding plate 1 and the plurality of teeth 221 of the upper holding plate 2 are alternately arranged in the width direction (the direction y) of the holding plates 1 and 2. With this configuration, the holding target object S can be reliably held while distributing the pressure to the holding target object S.

The body portion 41 of the bar member 4 extends in the longitudinal direction (the direction x) with a flat cross section. The cross section of the body portion 41 has a size in the direction y greater than that in the direction z. With this configuration, the body portion 41 can be elastically deformed relatively easily with a bending load in the direction z. Accordingly, even when the casing is curved, the body portion 41 (the bar member 4) can be deformed following the curved shape, and the bodkin A can be smoothly inserted into the casing.

The leading portion 42 of the bar member 4 has a part whose cross section is greater than the cross section of the body portion 41. In the illustrated example, at least the end part of the leading portion 42 that is connected to the body portion 41 is greater than the cross section of the body portion 41. Thus, the leading portion 42 can be easily pinched with the hand, and the bar member 4 can be smoothly pushed into the casing. Furthermore, the leading portion 42 is tapered. Accordingly, when drawing the bodkin A through the casing with the leading portion 42 of the bar member 4 serving as a leading end, the bar member 4 (the leading portion 42) can be smoothly pushed forward.

Furthermore, the bar member 4 (the body portion 41) is provided, on each of its faces oriented in the direction z, with a plurality of protrusions 411. With this configuration, when the bar member 4 inside the casing is pinched via the fabric, the protrusions 411 provide an anti-slip effect.

Above, a specific embodiment of the present invention was described, but the invention is not limited thereto, and various modifications can be made within the scope not departing from the spirit of the invention. Specific shapes, materials, and the like of the bodkin according to the present invention are not limited to those in the foregoing embodiment.

The invention claimed is:

1. A bodkin, comprising:

a first holding plate including a base end portion and a first front end portion that are spaced apart from each other in a first direction;

a second holding plate including a second front end portion and a base end portion opposite to the second front end portion, the second front end portion being arranged to overlap with the first front end portion as viewed in a second direction extending along a thickness direction of the first holding plate and perpendicular to the first direction;

an operation plate including a base end portion rotatable relative to the first holding plate about a third direction perpendicular to both the first direction and the second direction, the operation plate being configured to switch between an opened state and a closed state, wherein in the opened state the first front end portion and the second front end portion are apart from each other and in the closed state the first front end portion and the second front end portion are in contact with each other; and a bar member connected directly to the base end portion of the first holding plate and elongated in the first direction, the bar member being formed separately from the operation plate, wherein the opened state is attained by the operation plate standing upright with respect to the first holding plate, and the closed state is attained by the operation plate overlapping with the first holding plate, thereby pressing the second holding plate toward the first holding plate, and the bar member includes an elastically deformable body portion elongated in the first direction, and the body portion has a cross section that is greater in size in the third direction than in the second direction.

2. The bodkin according to claim 1, wherein the base end portion of the second holding plate is supported by the first holding plate rotatably about the third direction, the first holding plate is provided with a pair of upright pieces each disposed between the base end portion of the first holding plate and the first front end portion, the upright pieces being spaced apart from each other in the third direction and extending in the second direction, and the base end portion of the operation plate is rotatably supported by the pair of upright pieces.

3. The bodkin according to claim 2, wherein the pair of upright pieces are formed with holes, respectively, that are paired with each other in the third direction, and the base end portion of the operation plate is provided with projecting portions that are spaced apart from each other in the third direction and fitted into the holes of the upright pieces, respectively.

4. The bodkin according to claim 2, wherein the operation plate includes a front end portion opposite to the base end portion of the operation plate and includes an extending piece that extends from the base end portion of the operation plate and is capable of pressing the second holding plate, the extending piece extending in a direction intersecting a direction connecting the base end portion of the operation plate and the front end portion of the operation plate.

5. The bodkin according to claim 4, wherein in the closed state the second holding plate is elastically pressed against the first holding plate by the extending piece.

6. The bodkin according to claim 1, wherein the first front end portion is provided with a plurality of first teeth projecting toward the second holding plate and arranged at intervals in the third direction, the second front end portion is provided with a plurality of second teeth projecting toward the first holding plate and arranged at intervals in the third direction, and the plurality of first teeth and the plurality of second teeth are alternately arranged in the third direction.

7. The bodkin according to claim 1, wherein the bar member includes a leading portion connected to the body portion, and the leading portion tapers with increasing distance from the body portion.

8. The bodkin according to claim 7, wherein at least a part of the leading portion has a cross section that is greater in area than the cross section of the body portion.

9. The bodkin according to claim 1, wherein the operation plate is arranged above the base end portion of the first holding plate and the base end portion of the second holding plate in the second direction.

10. The bodkin according to claim 1, wherein the operation plate includes a front end portion opposite to the base end portion of the operation plate, and in the opened state, the front end portion of the operation plate stands upright away from the bar member.

* * * * *